US008522583B2

(12) United States Patent
Cumbo et al.

(10) Patent No.: US 8,522,583 B2
(45) Date of Patent: Sep. 3, 2013

(54) DOOR LATCH WITH EMERGENCY LOCK ACTUATOR AND 'IMPATIENT PASSENGER' FEATURE

(75) Inventors: Francesco Cumbo, Pisa (IT); Luca Bigazzi, Ponsacco (IT)

(73) Assignee: Magna Closures S.p.A., Guasticce (IT)

( * ) Notice: Subject to any disclaimer, the term of this patent is extended or adjusted under 35 U.S.C. 154(b) by 162 days.

(21) Appl. No.: 13/034,662

(22) Filed: Feb. 24, 2011

(65) Prior Publication Data

US 2011/0204673 A1 Aug. 25, 2011

Related U.S. Application Data

(60) Provisional application No. 61/307,602, filed on Feb. 24, 2010.

(51) Int. Cl.
*E05B 47/00* (2006.01)

(52) U.S. Cl.
USPC ..... 70/279.1; 70/283.1; 292/201; 292/216; 292/DIG. 23; 292/DIG. 26; 292/DIG. 27

(58) Field of Classification Search
USPC ..... 70/279.1–283.1; 292/201, 216, 292/DIG. 23, DIG. 26, DIG. 27
See application file for complete search history.

(56) References Cited

U.S. PATENT DOCUMENTS

| | | | | |
|---|---|---|---|---|
| 4,904,006 | A * | 2/1990 | Hayakawa et al. | 292/336.3 |
| 5,106,133 | A * | 4/1992 | Fukumoto et al. | 292/201 |
| 5,474,338 | A * | 12/1995 | Buscher | 292/201 |
| 5,584,515 | A * | 12/1996 | Silye | 292/201 |
| 5,667,263 | A * | 9/1997 | Kleefeldt et al. | 292/336.3 |
| 5,803,515 | A * | 9/1998 | Arabia et al. | 292/216 |
| 5,931,034 | A * | 8/1999 | Fisher | 70/264 |
| 5,971,448 | A * | 10/1999 | Hayakawa et al. | 292/216 |
| 6,045,168 | A * | 4/2000 | Johnson et al. | 292/216 |
| 6,540,271 | B1 * | 4/2003 | Kalsi | 292/216 |
| 6,601,883 | B1 * | 8/2003 | Kalsi | 292/216 |
| 6,951,355 | B2 * | 10/2005 | Hayakawa et al. | 292/201 |
| 6,988,749 | B2 * | 1/2006 | Hashiba et al. | 292/201 |
| 7,293,806 | B2 * | 11/2007 | Umino | 292/216 |
| 7,770,946 | B2 * | 8/2010 | Kouzuma | 292/201 |
| 7,780,207 | B2 * | 8/2010 | Gotou et al. | 292/336.3 |
| 8,146,965 | B2 * | 4/2012 | Akizuki et al. | 292/201 |

(Continued)

FOREIGN PATENT DOCUMENTS

| | | | |
|---|---|---|---|
| DE | 4108561 | C2 | 3/1993 |
| DE | 19934877 | A1 | 2/2000 |
| DE | 10211937 | A1 | 10/2003 |

*Primary Examiner* — Suzanne Barrett
(74) *Attorney, Agent, or Firm* — Millman IP Inc.

(57) ABSTRACT

In one aspect, the invention is directed to a closure latch for a vehicle door. The closure latch includes an emergency lock actuator to permit a person to lock the door in the event that the power lock actuator is unusable. The latch also includes an 'impatient passenger' feature, which permits the doors to be unlocked using the remote keyless-entry feature on the key fob even in a situation where an 'impatient passenger' had prematurely lifted the door handle of the vehicle. In some prior art latches, such an action by an 'impatient passenger' would prevent the drive motor on the latch from unlocking the latch, thereby necessitating the owner to press the unlock button on the key fob a second time. There is some overlap in the components that used for the 'impatient passenger' feature and the components used for the emergency lock actuator, thereby reducing cost and complexity of the latch.

7 Claims, 5 Drawing Sheets

(56) References Cited

U.S. PATENT DOCUMENTS

| | | | | |
|---|---|---|---|---|
| 8,182,004 | B2 * | 5/2012 | Yoda | 292/201 |
| 2003/0116977 | A1 * | 6/2003 | Erices | 292/201 |
| 2004/0056489 | A1 * | 3/2004 | Boecker et al. | 292/201 |
| 2004/0245786 | A1 * | 12/2004 | Hashiba et al. | 292/216 |
| 2011/0107800 | A1 * | 5/2011 | Barbier et al. | 70/101 |

* cited by examiner

DOOR LATCH WITH EMERGENCY LOCK ACTUATOR AND 'IMPATIENT PASSENGER' FEATURE

FIELD OF THE INVENTION

The present invention relates to a closure latch for a vehicle door, and more particularly to a closure latch having both an emergency lock actuator and an 'impatient passenger' feature.

BACKGROUND OF THE INVENTION

Some vehicle door closure latches equipped with a primary lock actuator (eg. a power lock actuator), also include an emergency lock actuator that can be used in the event of a failure of the primary lock actuator. Some latches also includes other features, such as, for example, an 'impatient passenger' feature. Such a feature permits the latch to be unlocked by the lock actuator motor even if an 'impatient passenger' had lifted the door handle prior to the vehicle owner actuating the motor. Such features, while beneficial to have, increase the cost and complexity of the latch, however.

It would be beneficial to provide a closure latch that provided these features, but that was relatively less complex.

SUMMARY OF THE INVENTION

In one aspect, the invention is directed to a closure latch for a vehicle door. The closure latch includes an emergency lock actuator to permit a person to unlock the door in the event that the power lock actuator is unusable. The latch also includes an 'impatient passenger' feature, which permits the doors to be unlocked using the remote keyless-entry feature on the key fob even in a situation where an 'impatient passenger' had prematurely lifted the door handle of the vehicle. In some prior art latches, such an action by an 'impatient passenger' would prevent the drive motor on the latch from unlocking the latch, thereby necessitating the owner to press the unlock button on the key fob a second time. There is some overlap in the components that used for the 'impatient passenger' feature and the components used for the emergency lock actuator, thereby reducing cost and complexity of the latch.

In a particular embodiment, the invention is directed to a closure latch for a vehicle door. The latch includes a ratchet, a pawl, an outsider door release lever, a lock link and a lock link driver. The ratchet is movable between an open position and a closed position and is biased towards the open position. The pawl is movable between a ratchet locking position wherein the pawl holds the ratchet in the closed position and a ratchet release position wherein the pawl permits the ratchet to move to the open position. The pawl is biased towards the ratchet locking position. The outside door release lever is movable between a home position and an actuated position. The outside door release lever is biased towards the home position. The lock link is movable between an unlocking position and a locking position. The lock link is biased towards the unlocking position by a lock link biasing member. When the lock link is in the unlocking position movement of the outside door release lever to the actuated position drives the pawl to the ratchet release position. When the lock link is in a locking position the outside door release lever is operatively disconnected from the pawl and movement of the outside door release lever to the actuated position prevents movement of the lock link from the locking position to the unlocking position. The lock link driver is movable between an unlocking position and a locking position. The lock link driver is operatively connected to the lock link through a slot-and-pin connection such that when the lock link driver is in the locking position the lock link is in the locking position, and when the lock link driver is in the unlocking position the lock link is urged towards the unlocking position by the lock link biasing member. When the lock link is prevented from movement to the unlocking position by the outside door release lever in the actuated position, movement of the outside door release lever to the home position permits movement of the lock link to the unlocking position under the urging of the lock link biasing member. The lock link driver includes a manual rotation feature thereon for manual rotation of the lock link driver at least to the unlocking position, wherein the manual rotation feature is accessible from the exterior of the vehicle door.

In another aspect, the invention is directed to a closure latch for a vehicle door that includes an emergency lock actuator that is integrated into the lock/unlock chain (ie. the chain of components involved in locking and unlocking the latch) without necessitating the need for many additional components.

BRIEF DESCRIPTION OF THE DRAWINGS

The present invention will now be described by way of example only with reference to the attached drawings, in which.

DETAILED DESCRIPTION OF THE INVENTION

Figure 1:
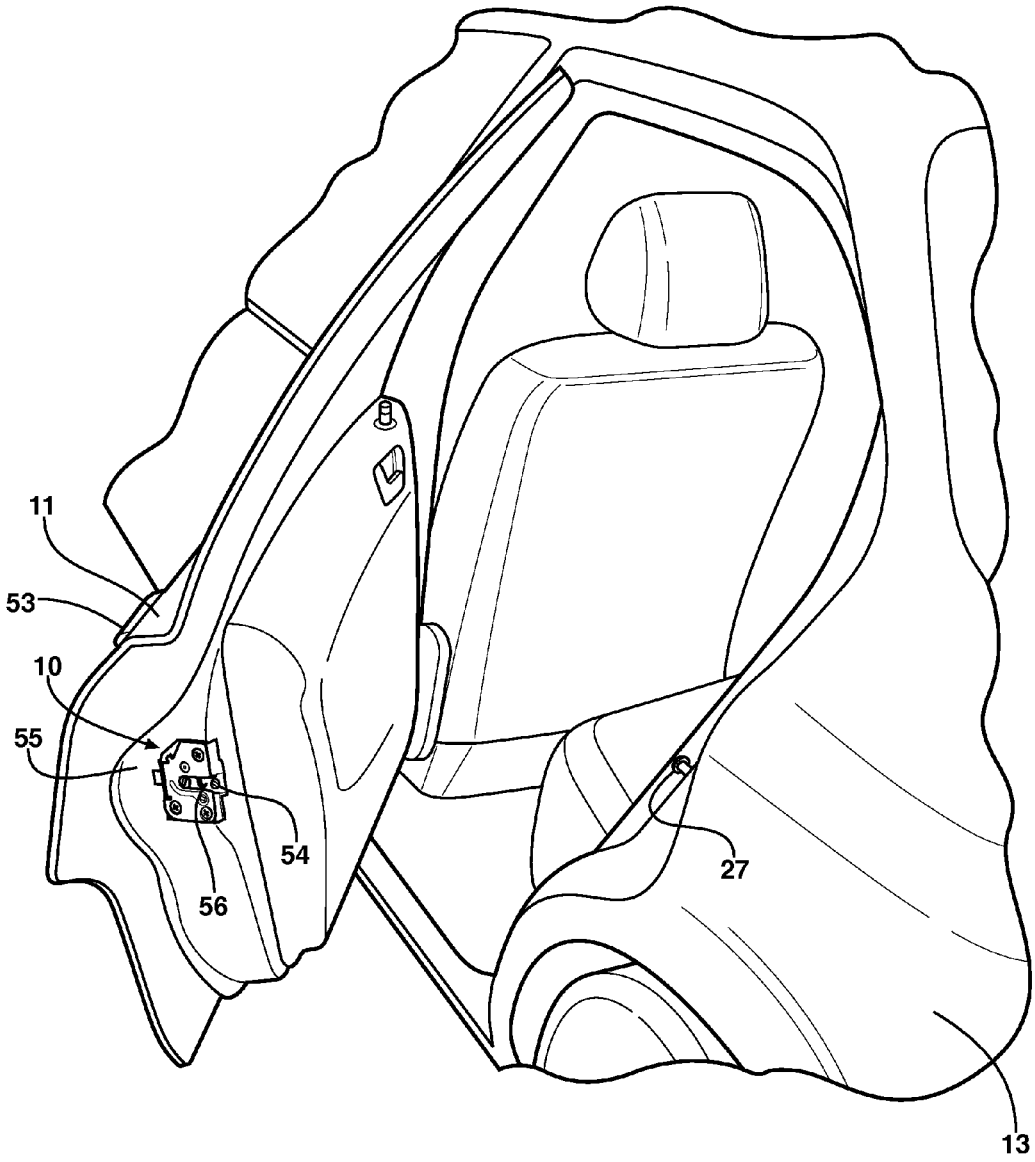
FIG. 1 is a perspective view of a closure latch for a vehicle door in accordance with an embodiment of the present invention.
Figure 2:
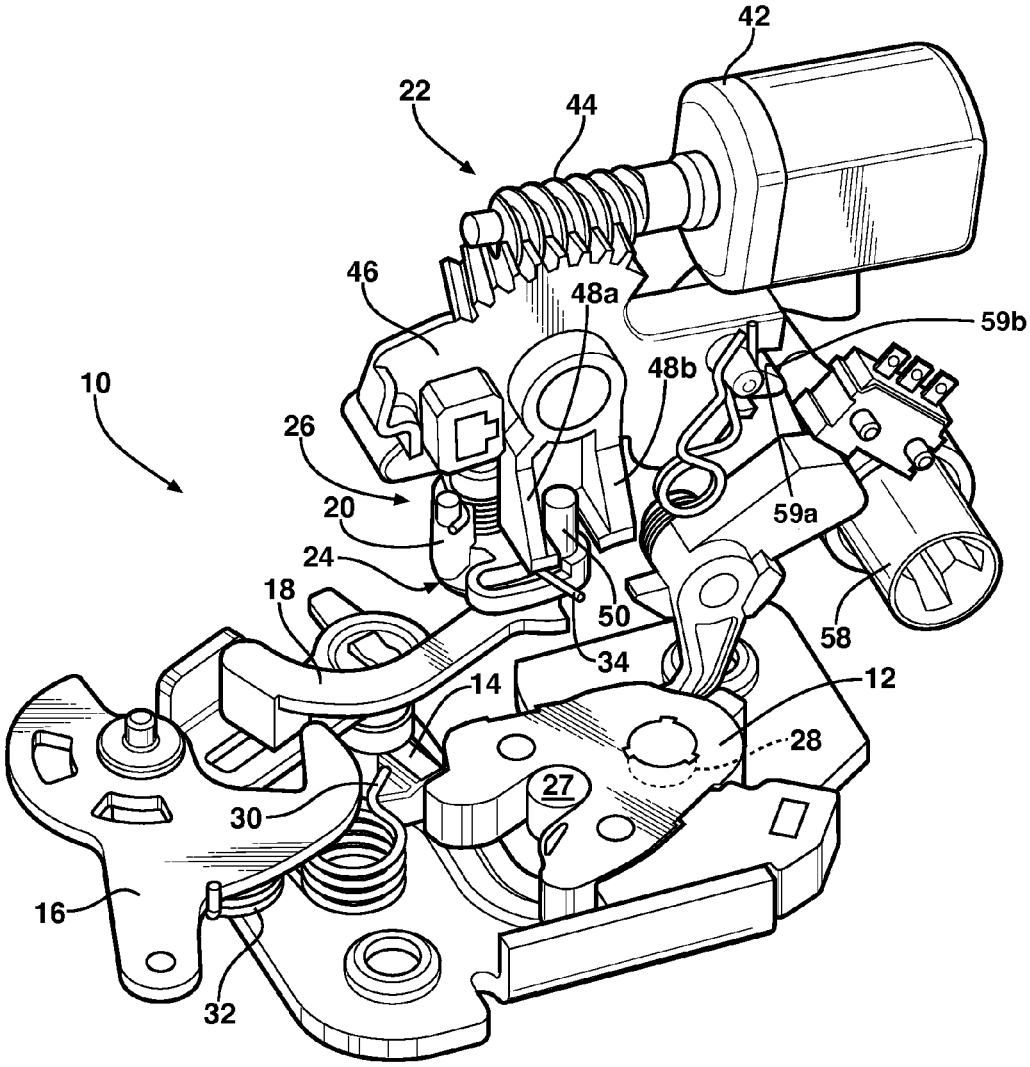
FIG. 2 is a magnified perspective view of the closure latch shown in FIG. 1, showing an outside door release lever in a home position, a lock link in an unlocking position and a lock link driver in an unlocking position.

Reference is made to FIG. 1, which shows a closure latch 10 for a vehicle door 11 of a vehicle 13, in accordance with an embodiment of the present invention. Referring to FIG. 2, the closure latch 10 includes a ratchet 12, a pawl 14, an outside door release lever 16, a lock link 18, a lock link driver 20, a power lock actuator 22, an emergency lock actuator 24, and an 'impatient passenger' structure 26. The closure latch 10 may include other elements not described above, such as, for example, an inside door release lever, which are, in the embodiment shown in the figures, not directly related to the invention.

The ratchet 12 is movable between a closed position (FIG. 2) wherein the ratchet 12 retains a striker 27 mounted on the body (not shown) of the vehicle, and an open position wherein the ratchet 12 is unengaged with the striker 27. A ratchet biasing member 28 such as a suitable spring may be provided to bias the ratchet 12 towards the open position.

The pawl 14 is movable between a ratchet locking position (FIG. 2) wherein the pawl 14 holds the ratchet 12 in the closed position, and a ratchet release position wherein the pawl 14 permits the ratchet 12 to move to its open position. A pawl biasing member 30 such as a suitable spring may be provided to bias the pawl 14 towards the ratchet locking position.

The outside door release lever 16 is movable by a cable from an outside door handle between a home position and an actuated position, and is biased towards the home position by an outside door release lever biasing member 32.

The lock link 18 is movable between an unlocking position (FIG. 2) and a locking position (FIG. 3*a*), and is biased towards the unlocking position by a lock link biasing member 34. When the lock link 18 is in the unlocking position, it operatively connects the outside door release lever 16 to the pawl 14, so that actuation of the outside door release lever 16 from the home position to the actuated position drives the pawl 14 to move to its ratchet release position.

Figure 3A:
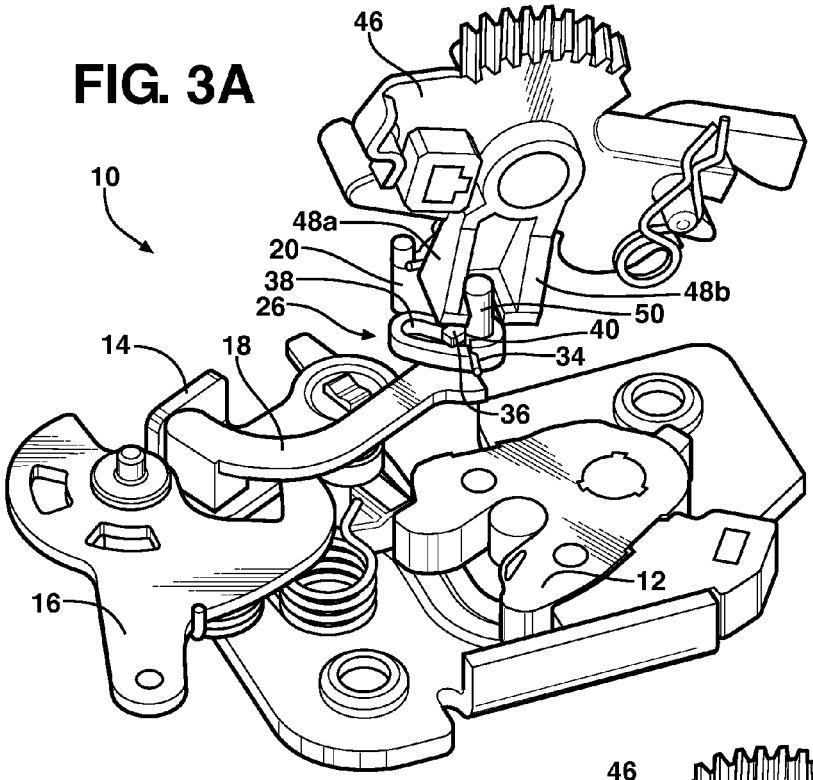
FIGS. 3*a* and 3*b* are perspective views illustrating the operation of the outside door release lever when the lock link is in a locking position.
Figure 3B:
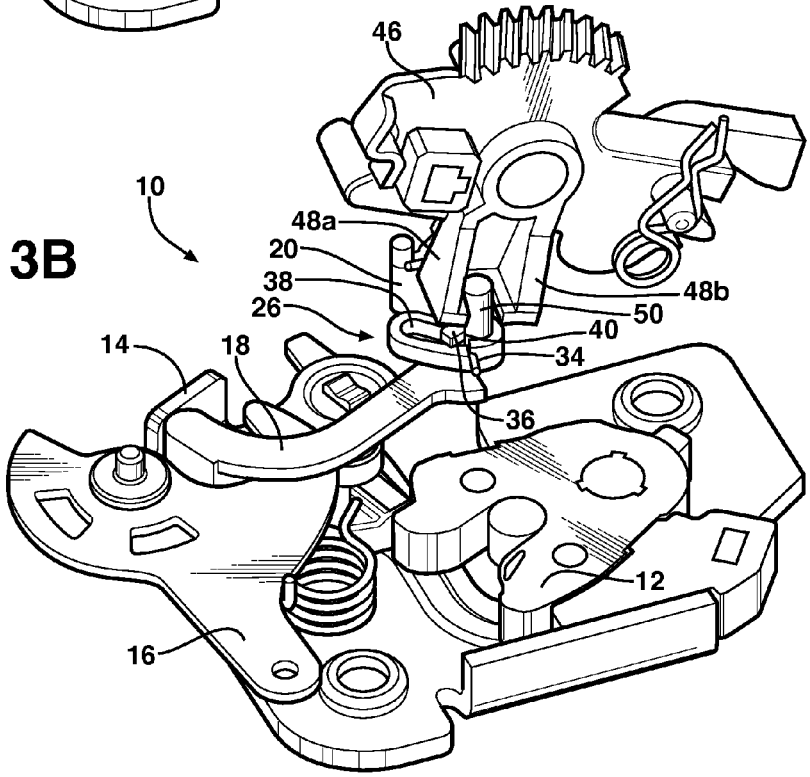

When the lock link 18 is in the locking position, shown in FIG. 3*a*, the outside door release lever 16 is operatively disconnected from the pawl 14. As a result when the outside door release lever 16 is moved from its home position (FIG. 3*a*) to its actuated position (shown in FIG. 3*b*), the outside door release lever 16 does not drive the pawl 14 from its ratchet locking position (ie. it permits the pawl 14 to be in the ratchet locking position).

The lock link 18 has an arm 36 that is captured in a slot 38 of the lock link driver 20. The lock link driver 20 is pivotable between an unlocking position (FIG. 2) and a locking position (FIG. 3*a*). The arm 36 is biased to a first end 40 of the slot 38 by the lock link biasing member 34.

Referring to FIG. 2, movement of the lock link driver 20 can be carried out either by the power lock actuator 22 or the emergency lock actuator 24. The power lock actuator 22 may include any suitable structure permitting it to be operatively connected to the lock link driver 20. In the exemplary embodiment shown in FIG. 2, the power lock actuator 22 includes a bidirectional electric motor 42 which drives a worm gear 44, which in turn drives a sector gear member 46. The sector gear member 46 has thereon a pair of arms 48*a* and 48*b*, which engage a pin 50 on the lock link driver 20 thereby operatively connecting the power lock actuator 22 to the lock link driver 20 and thus to the lock link 18. When the motor 42 drives the worm gear 44 in a first worm gear direction, the worm gear 44 in turn drives the sector gear member 46 in a first sector gear direction (clockwise in the view shown in FIG. 2), which drives the lock link driver 20 (through engagement with the pin 50) to the locking position (FIG. 3*a*), thereby driving the lock link 18 to its locking position shown in FIG. 3*a*. When the motor 42 drives the worm gear 44 in a second worm gear direction (which is opposite to the first worm gear direction), the worm gear 44 in turn drives the sector gear member 46 in a second sector gear direction (which is opposite to the first sector gear rotation), which in turn drives the lock link driver 20 (through engagement with the pin 50) to the unlocking position (FIG. 2), thereby urging the lock link 18 towards its unlocking position by means of the lock link biasing member 34.

Figure 4A:
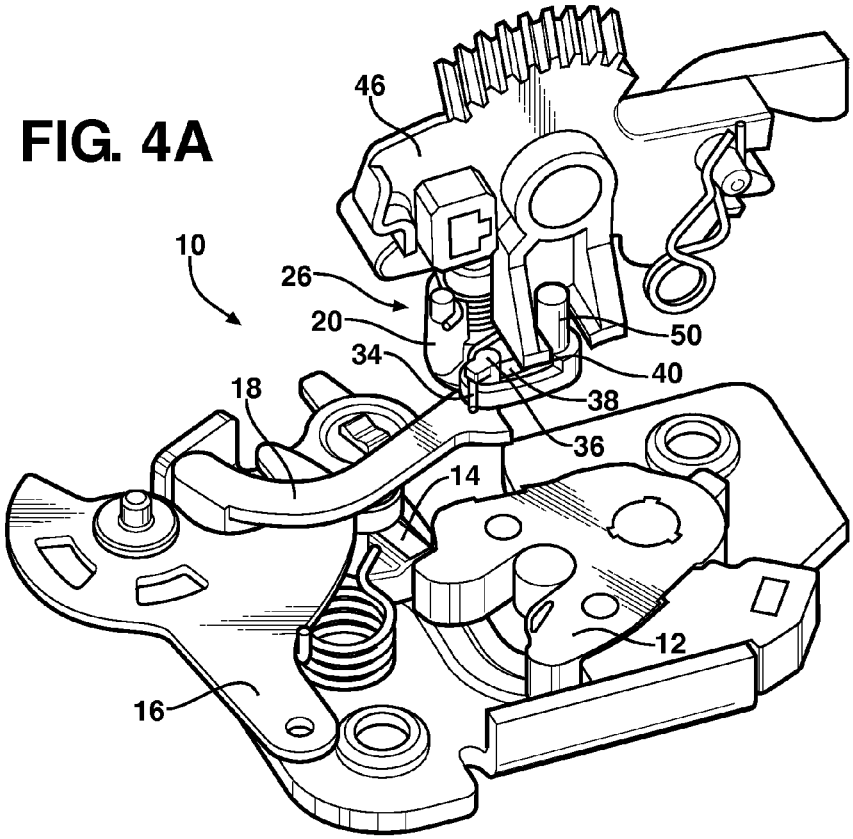
FIGS. 4*a* and 4*b* are perspective views of the closure latch shown in FIG. 2, illustrating the operation of an 'impatient passenger' feature.

With reference to FIG. 4*a*, if the outside door release lever 16 is in the actuated position while the lock link driver 20 is moved to its unlocking position, the outside door release lever 16 prevents the lock link 18 from moving to the unlocking position. In such a situation, until the outside door release lever 16 is released and thereby permitted to move back to its home position, the lock link 18 remains in its locking position. In such a situation, it can be seen in FIG. 4*a* that the arm 36 is no longer at the first end 40 of the slot 38. The slot 38 thus permits the lock link driver 20 to be moved to its unlocking position even in a situation when the lock link 18 is prevented from leaving the locking position by the outside door release lever 16. An example of when this situation can occur is described further below.

Figure 4B:
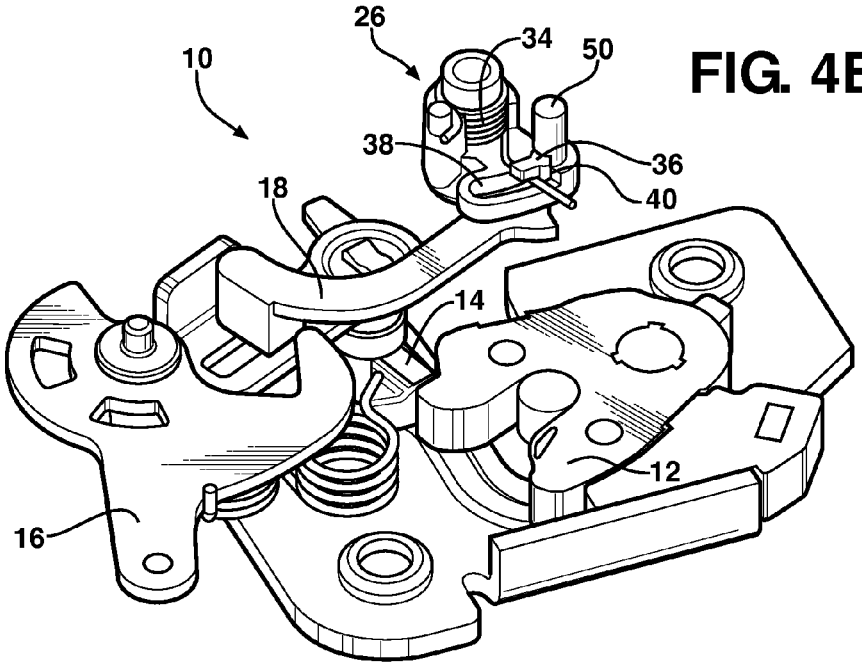

With reference to FIG. 4*b*, when the outside door release lever 16 is finally released from its actuated position and is permitted to move back to its home position, the lock link 18 is moved to its unlocking position under the urging of the lock link biasing member 34.

During use of the vehicle latch 10 the situation illustrated in FIG. 4*a* can occur when a first person (eg. the vehicle owner) presses an 'unlock' button on a key fob, and during this action, an impatient passenger eager to enter the vehicle prematurely lifts the outside door handle (shown at 53 in FIG. 1), thereby actuating the outside door release lever 16 before the lock link 18 has been moved to its unlocking position. As a result, while the passenger keeps the outside door handle 53 (FIG. 1) lifted, the lock link 18 (FIG. 4*a*) is prevented from moving from the locking position to the unlocking position, but when the passenger releases the door handle 53 (FIG. 1), the outside door release lever 16 moves back to its home position and the lock link 18 can then move to its unlocking position under the urging of the lock link biasing member 34. By contrast, in some prior art vehicular latches (not shown), there is no slot connection between the lock link and whatever drives the lock link, and so, in such a situation where an impatient passenger lifts the door handle 53 (FIG. 1) before the vehicle owner presses the unlock button, the lock link and any members that drive the lock link are all prevented from moving to their respective unlocking positions. As a result, when the door handle 53 (FIG. 1) is finally released in such prior art latches, there is nothing urging the lock link to its unlocking position, and so the vehicle owner must then press the 'unlock' button a second time in order for the unlocking action to be carried out.

This structure (ie. the slot 38 and pin 36 connection between the lock link 18 and the lock link driver 20, and the lock link biasing member 34 for biasing the lock link 18 to its unlocking position) together make up the 'impatient passenger' structure 26.

The lock link driver 20 (FIGS. 5*a* and 5*b*) includes a manual rotation feature 54 (which in the embodiment shown is a tool-receiving feature 54) that permits it to be rotated between its locking position (FIG. 5*a*) and its unlocking position (FIG. 5*b*), thereby permitting the vehicle door 11 (FIG. 5*b*) to be locked (and unlocked if desired) in the event that the power lock actuator 22 is unusable. For example in the event of a failure of some element that controls operation of the power lock actuator 22 (eg. a disconnection between the motor 42 and its power source, or a failure of the motor 42), the vehicle owner cannot use the power lock actuator 22 to lock or unlock the latch 10. In such a situation, an appropriate tool could be inserted into the tool-receiving feature 54 (FIG. 5*a*) and could be used to manually rotate the lock link driver 20 to its locking position, which in turn drives the lock link 18 (FIG. 2) to its locking position. The lock link driver 20 with the manual rotation feature 54 thus constitutes the emergency lock actuator 24. This permits the vehicle owner to lock the vehicle as needed until he or she can have the vehicle repaired.

In the embodiment shown, driving the lock link driver 20 manually by means of the emergency lock actuator 24 causes the sector gear member 46 (FIG. 2) to rotate, which in turn causes the worm gear 44 to rotate. It will be understood that these components (ie. the sector gear member 46, the worm gear 44 and the electric motor 42) are configured to accommodate being back-driven by the lock link driver 24. For example, the shape and pitch of the thread on the worm gear 44 may be selected to permit the worm gear 44 to be back-driven by the sector gear member 46.

Figure 5A:
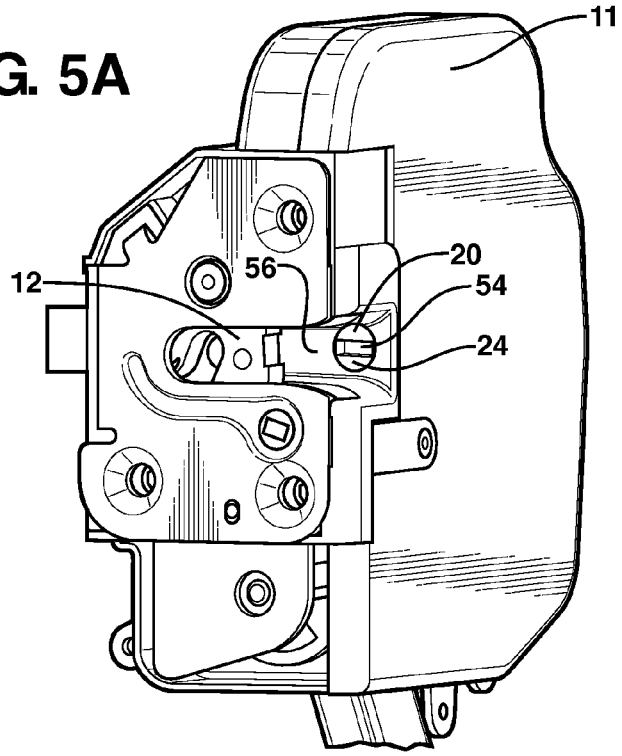
FIGS. 5*a* and 5*b* are perspective views of the closure latch shown in FIG. 2, illustrating the operation of an emergency lock actuator.
Figure 5B:
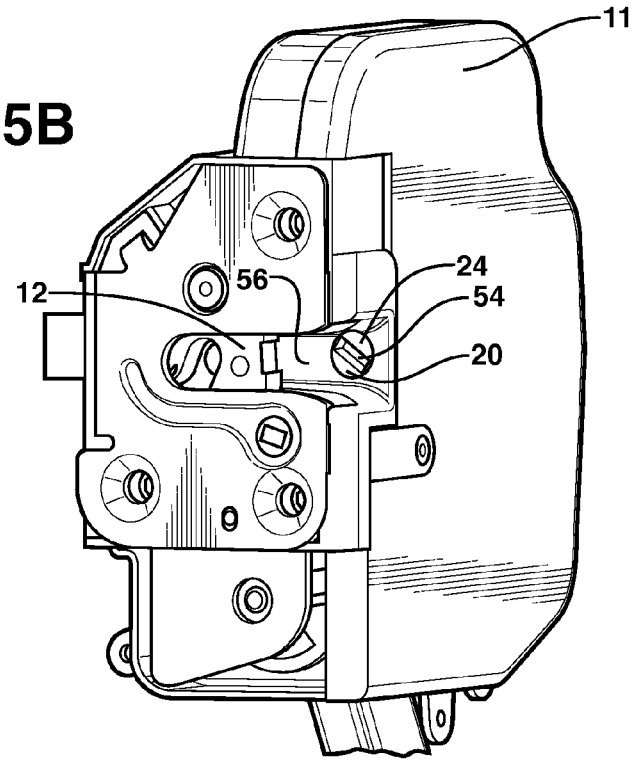

As can be seen in FIGS. 5*a* and 5*b*, the emergency lock actuator 24 is accessible from the exterior of the vehicle door 11. For greater clarity, the 'exterior of the vehicle door' refers to any exterior portion of the vehicle door, such as the face of the door that faces the exterior of the vehicle, the face of the door that faces the interior of the vehicle, and the edge face of the door (shown in FIG. 1 at 55). In the embodiment shown in the figures, the emergency lock actuator 24 is accessible from the edge face 55 of the door 11 proximate the fishmouth of the vehicle latch 10, which is shown at 56. As a result, the emergency lock actuator 24 is inaccessible from outside the vehicle when the door 11 is closed, thereby preventing a would-be thief from using it to gain entry into the vehicle. It is inaccessible from inside the vehicle when the door 11 is closed. As a result, a would-be thief cannot access it using tools slipped in from above the window seal from the outside of the vehicle. Such tools have been used in the past by thieves to unlock the door by actuating a lock knob located on the door sill or in other parts of the inside facing door panel.

The lock link driver 20 with the integral manual rotation feature 54 that is accessible from the exterior of the door 11 (eg. from the door edge as shown in FIGS. 5*a* and 5*b*), and with the integral slot 38 (FIG. 2), combined with the lock link biasing spring 34 constitute a simple, inexpensive means for providing emergency lock actuation and for providing an 'impatient passenger' feature.

Referring to FIG. 2, the vehicle door 11 may further include a key cylinder 58 that permits the latch 10 to be unlocked manually (ie. by means of a mechanical connection between the key cylinder 58 and the lock link 18, via engagement of surface 59*a* on key cylinder 58 with surface 59*b* on lock link driver 20 wherein rotation of the key cylinder 58 rotates the lock link driver 20 and therefore the lock link 18 between the locking and unlocking positions) from the exterior of the vehicle by a person with a key. This permits the vehicle owner to unlock or lock the latch 10 on a closed door 11 from outside the vehicle when the power lock actuator 22 is not usable. On a vehicle, which typically has two or more doors, at least one of the doors includes a key cylinder 58 and the remaining doors do not have a key cylinder. In this way, all the doors can be locked (by the emergency lock actuator 24 on doors so equipped, and by the key cylinder 58 on doors so equipped). Entry back into the vehicle is provided by means of any doors with the key cylinder 58. Once inside the vehicle, the door latches on the other doors may be configured so that the inside door handle can be pulled on them to automatically unlock and open them.

While the above description constitutes a plurality of embodiments of the present invention, it will be appreciated that the present invention is susceptible to further modification and change without departing from the fair meaning of the accompanying claims.

We claim:

1. A closure latch for a vehicle door, comprising:

a ratchet movable between an open position and a closed position and biased towards the open position;

a pawl movable between a ratchet locking position wherein the pawl holds the ratchet in the closed position and a ratchet release position wherein the pawl permits the ratchet to move to the open position, and wherein the pawl is biased towards the ratchet locking position;

an outside door release lever movable between a home position and an actuated position, wherein the outside door release lever is biased towards the home position;

a lock link movable between an unlocking position and a locking position, wherein the lock link is biased towards the unlocking position by a lock link biasing member, wherein when the lock link is in the unlocking position movement of the outside door release lever to the actuated position drives the pawl to the ratchet release position, and wherein when the lock link is in a locking position the outside door release lever is operatively disconnected from the pawl and movement of the outside door release lever to the actuated position prevents movement of the lock link from the locking position to the unlocking position; and a lock link driver movable between an unlocking position and a locking position, wherein the lock link driver is operatively connected to the lock link through a slot-and-pin connection such that when the lock link driver is in the locking position the lock link is in the locking position, and when the lock link driver is in the unlocking position the lock link is urged towards the unlocking position by the lock link biasing member, wherein when the lock link is prevented from movement to the unlocking position by the outside door release lever in the actuated position, movement of the outside door release lever to the home position permits movement of the lock link to the unlocking position under the urging of the lock link biasing member, and wherein the lock link driver includes a manual rotation feature thereon for manual rotation of the lock link driver at least to the unlocking position, wherein the manual rotation feature is accessible from the exterior of the vehicle door.

2. A closure latch as claimed in claim 1, further comprising a power lock actuator, wherein the power lock actuator includes an electric motor that is operatively connected to the lock link driver.

3. A closure latch as claimed in claim 1, further comprising a key cylinder operatively connected to the lock link driver such that rotation of the key cylinder rotates the lock link between the locking and unlocking positions.

4. A closure latch as claimed in claim 1, wherein the manual rotation feature is accessible from an edge face of the door, such that the manual rotation feature is inaccessible from outside the vehicle and from inside the vehicle when the door is closed.

5. A closure latch as claimed in claim 1, wherein the manual rotation feature is a tool-receiving feature.

6. A vehicle comprising:

a vehicle body;

a first door and a second door, wherein the first door contains a first vehicle latch, including a ratchet movable between an open position and a closed position and biased towards the open position;

a pawl movable between a ratchet locking position wherein the pawl holds the ratchet in the closed position and a ratchet release position wherein the pawl permits the ratchet to move to the open position, and wherein the pawl is biased towards the ratchet locking position;

an outside door release lever movable between a home position and an actuated position, wherein the outside door release lever is biased towards the home position;

a lock link movable between an unlocking position and a locking position, wherein the lock link is biased towards the unlocking position by a lock link biasing member, wherein when the lock link is in the unlocking position movement of the outside door release lever to the actuated position drives the pawl to the ratchet release position, and wherein when the lock link is in a locking position the outside door release lever is operatively disconnected from the pawl and movement of the outside door release lever to the actuated position prevents movement of the lock link from the locking position to the unlocking position; and a lock link driver movable between an unlocking position and a locking position, wherein the lock link driver is operatively connected to the lock link through a slot-and-pin connection such that when the lock link driver is in the locking position the lock link is in the locking position, and when the lock link driver is in the unlocking position the lock link is urged towards the unlocking position by the lock link biasing member, wherein when the lock link is prevented from movement to the unlocking position by the outside door release lever in the actuated position, movement of the outside door release lever to the home position permits movement of the lock link to the unlocking position under the urging of the lock link biasing member, and wherein the lock link driver includes a manual rotation feature thereon for manual rotation of the lock link driver at least to the unlocking position, wherein the manual rotation feature is accessible from the exterior of an edge face of the first vehicle door, and wherein the second door contains a second vehicle latch and a key cylinder operatively connected to the second vehicle latch by a mechanical connection for unlocking and locking the second vehicle latch from the outside of the vehicle.

7. A closure latch for a vehicle door, comprising:

a ratchet movable between an open position and a closed position and biased towards the open position;

a pawl movable between a ratchet locking position wherein the pawl holds the ratchet in the closed position and a ratchet release position wherein the pawl permits the ratchet to move to the open position, and wherein the pawl is biased towards the ratchet locking position;

an outside door release lever movable between a home position and an actuated position, wherein the outside door release lever is biased towards the home position;

a lock link movable between an unlocking position and a locking position, wherein the lock link is biased towards the unlocking position by a lock link biasing member, wherein when the lock link is in the unlocking position movement of the outside door release lever to the actuated position drives the pawl to the ratchet release position, and wherein when the lock link is in a locking position the outside door release lever is operatively disconnected from the pawl and movement of the outside door release lever to the actuated position prevents movement of the lock link from the locking position to the unlocking position; and a lock link driver movable between an unlocking position and a locking position, wherein the lock link driver is operatively connected to the lock link through a slot-and-pin connection such that when the lock link driver is in the locking position the lock link is in the locking position, and when the lock link driver is in the unlocking position the lock link is urged towards the unlocking position by the lock link biasing member, wherein when the lock link is prevented from movement to the unlocking position by the outside door release lever in the actuated position, movement of the outside door release lever to the home position permits movement of the lock link to the unlocking position under the urging of the lock link biasing member, and wherein the lock link driver includes a manual rotation feature thereon for manual rotation of the lock link driver at least to the unlocking position, wherein the manual rotation feature is accessible from the exterior of the vehicle door, wherein the manual rotation feature is a slot on the lock link driver.

* * * * *